US006862012B1

(12) United States Patent
Funakoshi et al.

(10) Patent No.: US 6,862,012 B1
(45) Date of Patent: Mar. 1, 2005

(54) WHITE POINT ADJUSTING METHOD, COLOR IMAGE PROCESSING METHOD, WHITE POINT ADJUSTING APPARATUS AND LIQUID CRYSTAL DISPLAY DEVICE

(75) Inventors: Akihiro Funakoshi, Kamakura (JP); Toshio Shimizu, Sagamihara (JP); Takuya Ishikawa, Hino (JP)

(73) Assignee: International Business Machines Corporation, Armonk, NY (US)

( * ) Notice: Subject to any disclaimer, the term of this patent is extended or adjusted under 35 U.S.C. 154(b) by 264 days.

(21) Appl. No.: 09/691,088

(22) Filed: Oct. 18, 2000

(30) Foreign Application Priority Data

Oct. 18, 1999 (JP) ..... 11-295453

(51) Int. Cl.[7] ..... G09G 3/36

(52) U.S. Cl. ..... 345/88; 345/101; 345/102; 345/89

(58) Field of Search ..... 345/87–102, 605, 345/690, 691

(56) References Cited

U.S. PATENT DOCUMENTS 5,638,117 A * 6/1997 Engeldrum et al. ..... 348/179
5,663,770 A * 9/1997 Yamade ..... 348/656
5,852,430 A * 12/1998 Endo ..... 345/101
5,956,006 A * 9/1999 Sato ..... 345/88
6,025,823 A * 2/2000 Choi ..... 345/101
6,256,425 B1 * 7/2001 Kunzman ..... 382/274
6,271,825 B1 * 8/2001 Greene et al. ..... 345/694
6,611,249 B1 * 8/2003 Evanicky et al. ..... 345/102

FOREIGN PATENT DOCUMENTS

JP PUPA 06-022329 1/1994
JP PUPA 11-069370 3/1999
JP PUPA 2001-013931 1/2001

* cited by examiner

*Primary Examiner*—Amr A. Awad
(74) *Attorney, Agent, or Firm*—Scully, Scott, Murphy & Presser; Robert M. Trepp, Esq.

(57) ABSTRACT

A white point adjusting apparatus is provided to adjust an achromatic color level for an input video signal including a plurality of color signals, and display an adjusted image on a liquid crystal module. This adjusting apparatus comprises: a first table for setting a white point by deciding an offset quantity of at least one color signal from a highest gray level for each color temperature; a second table for setting an offset quantity of the color signal to converge a halftone white point for each color temperature set by the first table; and a white point adjusting unit for adding the offset quantities set by the first and second tables and to the input video signal.

14 Claims, 8 Drawing Sheets

| Color Temperature | Offset Quantity | |
|---|---|---|
| | Red | Green |
| | | |
| 5500K | 0 | 0 |
| 6500K | -r1 | -g1 |
| 7500K | -r2 | -g2 |
| 8500K | -r3 | -g3 |
| 9500K | -r4 | -g4 |

Table 1: Offset Quantity for each Color Temperature Setting

FIG. 3

| Gray Level | Offset Quantity | | |
|---|---|---|---|
| | Red | Green | Blue |
| 255 | 0 | 0 | 0 |
| 223 | rr1 | gg1 | bb1 |
| 191 | rr2 | gg2 | bb2 |
| 159 | rr3 | gg3 | bb3 |
| 127 | rr4 | gg4 | bb4 |
| : | : | : | : |
| : | : | : | : |
| 32 | rr8 | gg8 | bb8 |
| 0 | rr9 | gg9 | bb9 |

Table 2: Offset Quantity at Specified Color Temperature

FIG. 4

Gamma Characteristic Adjustment
by Transformation of Gray Level Interval

Transformation of Gray Level Interval

IPS White Horiz. Viewing Adjusted

WHITE POINT ADJUSTING METHOD, COLOR IMAGE PROCESSING METHOD, WHITE POINT ADJUSTING APPARATUS AND LIQUID CRYSTAL DISPLAY DEVICE

BACKGROUND OF THE INVENTION

1. Technical Field

The present invention relates to a color image processing to technology for a color output device. More particularly, the invention relates to a method and an apparatus for adjusting a white point with higher accuracy in a liquid crystal display device.

2. Prior Art

As display devices for image displaying on a personal computer, a television set or the like, and for various other monitors, in addition to a CRT, liquid crystal devices (LCD) have come into wide use in recent years. In a color display system using the CRT, the LCD or the like, it is considered ideal to bring colors to be reproduced as close as possible to natural ones. It is also required that an apparatus should make an automatic adjustment or an operator (user) should make a manual adjustment according to the installing state of the apparatus using the CRT or the LCD, i.e., an environment of illumination or the like where the apparatus is set, in order to display an optimal color suited to each environment. In addition, it is strongly demanded that the capability of displaying a same color irrespective of the kind of an output device should be provided. Among these technologies, great importance is placed especially on a white point adjustment designed to adjust an achromatic color level in displaying, and such a white point adjustment has conventionally been realized for a color monitor or the like.

To treat all natural colors in a quantitative manner, a ClExy chromaticity diagram shown in FIG. 8 is available. This drawing represents a hue and color saturation of a given color on the basis of the position of a chromaticity coordinate, specifically showing a chromaticity coordinate represented by the axis of abscissa x=X÷(X+Y+Z) and the axis of ordinate y=Y÷(X+Y+Z) in tristimulus values X, Y and Z of an XYZ display system. For a portion on a closed curve C formed in a horseshoe shape and an inner portion thereof in the drawing, the entire range of colors seen by human eyes is _shown. Points R. G and B in the drawing respectively represent display colors based only on primary colors of R (red), G (green) and B (blue) in a particular color display system. All the colors on the sides of a triangle RGB and in an inner portion thereof can be expressed by means of proper mixing of R, G and B. Further, white having maximum luminance can be obtained typically as a mixed color W when each of R, G and B is set at maximum luminance, and this white color is usually located in the vicinity of an intersection of medians of the triangle R, G and B as shown in the drawing.

When designing a color display system, a more optimal white point is decided by adjusting maximum luminance values of the points R, G and B or changing the positions of the points R, G and B in the drawing. For example, in the color display system using the LCD, preferably, a white point should be decided by taking into consideration a spectral radiation characteristic of a backlight or a transmission characteristic of a color, filter.

In the prior art, for example, there is Japanese Patent Laid-Open No. Hei 2(1990)-271389 gazette. This gazette discloses a technology to correct gray level data so as to set a liquid crystal luminance-gray level data characteristic to be linear, in order to enable full-color image displaying having excellent display quality to be performed by preventing color shifting. Another gazette of Japanese Patent Laid-Open No. Hei 2(1990)-271793 discloses a technology to adjust chromaticity by uniformly increasing luminance of a low gray level side of B (blue) or R (red)/G (green) and preventing a reduction in luminance of the entire screen, when low gray level displaying continues.

On the other hand, as one of the problems inherent in a TFT LCD monitor or the like, a phenomenon of blue shifting occurs in halftone gray (halftone achromatic color) especially at a low gray level. This phenomenon specifically refers to a case where during displaying of an achromatic color (i.e., color with R, G and B set at the same gray level) on the TFT LCD device, the color becomes bluish (i.e., the chromaticity coordinate shifts toward a blue color) as a gray level value thereof is, reduced.

FIG. 9 shows a color temperature change for each gray level in the LCD by using a CIE chromaticity coordinate. The axis of abscissa x and the axis of ordinate y form a chromaticity coordinate, which is expressed by an abscissa x=X÷(X+Y+Z) and an ordinate y=Y÷(X+Y+Z) in tristimulus values X, Y and Z. In the drawing, a broken line indicates a black body locus, showing that a color becomes bluish with a color temperature increased toward the oblique left lower direction. In the drawing, gray to levels are also shown that, in the LCD panel, from the highest (255) to the lowest levels (0) respectively by 5 points when viewed from front face and when viewing angles are increased by means of shifting of 15 degrees, 30 degrees, 45 degrees and 60 degrees in a horizontal direction. The moving direction of a white point is indicated by a solid-line arrow A when a gray level is decreased, and the moving direction of each of the gray to levels when viewed from the front face and when the viewing angles are increased by means of shifting of 15 degrees, 30 degrees, 45 degrees and 60 degrees towards the front face and in the horizontal direction is indicated by a broken-line arrow B.

As apparent from FIG. 9, it can be understood that as a characteristic of the LCD, the white point defined bye the highest gray level is greatly shifted at the other halftone gray levels. In other words, toward the low gray level, the white point is shifted to a bluish direction on the CIE chromaticity coordinate. This phenomenon is caused by the change of light leakage, which occurs depending on the inclination of a liquid crystal when the liquid crystal cuts off a light. Once such a phenomenon occurs, the white point is greatly shifted from its setting at the low gray level even if the white point of the highest gray level can be adjusted to a desired chromaticity coordinate (color temperature). This phenomenon has been very conspicuous in certain kinds of LCD panels, posing a new problem to be solved.

As shown in the drawing, because of color shifting caused by a viewing angle, in connection with the foregoing phenomenon of color shifting at the halftone gray level, color shifting is increased from a white point spec value of a white color at the halftone gray level. There has been a strong demand for assurance of a high viewing angle in the LCD in recent years. But a more conspicuous occurrence of color shifting as the angle of viewing (viewing angle) the display is inclined from the front face has been another serious problem.

In the gazettes of Japanese Patent Laid-Open No. Hei 2(1990)-271389 and Patent Laid-Open No. Hei 2(1990)-271793 of the prior art, no mention is made for the need to correct white point shifting at the halftone gray level. Especially, in the gazette of Japanese Patent Laid-Open No. Hei 2(1990)-271389, a technology is disclosed that a luminance ratio of R, G and B is maintained constant at all the gray levels. But this maintenance technology of the constant luminance ratio is completely different from maintenance technology of a constant white point at all the gray levels in the case of the LCD.

Furthermore, for example, even with the assumption that setting of a color temperature is changed by a method: of changing luminance and mixture of R, G and B colors or a method of adjusting each luminance of a plurality of fluorescent tubes having different spectrum characteristics, panel luminance varies between high and low temperature sides in the case of adjusting a white point defined by a highest gray level. In other words, a problem has been occurred that a highest luminance defined at a certain white point cannot be guaranteed at other white points.

SUMMARY OF THE INVENTION

Yet another object of the invention is to provide a white point adjusting method and an apparatus capable of guaranteeing a color temperature even if a contrast adjustment is made on a liquid crystal module, and even dealing with the contrast adjustment itself of the liquid crystal module.

In order to achieve the foregoing objects, the present invention provides a white point adjusting method for adjusting an achromatic color level displayed on a liquid crystal module for an input video signal including a plurality of color signals. This adjusting method comprises: a first step of setting a white point by deciding an offset quantity of at least one color signal from a highest gray level for each color temperature; a second step of setting an offset quantity of the color signal in a direction of converging a white point at a halftone gray level for each color temperature set in the first step; and a third step of adjusting chromaticity on a screen of the liquid crystal module by adding the offset quantity decided in the first step and the offset quantity set in the second step to the input video signal (third step).

In this case, the input video signal is composed of R, G and B color signals, and for the white point setting in the first step, a prescribed color temperature is set as a default value. If a color temperature is set to a high temperature side with respect to the prescribed color temperature, luminance of R (red) and G (green) color signals is reduced. Thus, by using a color temperature of a low side as a reference, luminance of B (blue) can be increased in relative fashion even in an LCD having luminance which cannot be increased exceeding highest luminance. As a result, even at a high color temperature, an adjustment can be made in such a manner as to set a white point of a highest gray level on a coordinate of each color temperature on a CIE chromaticity coordinate. To set a color temperature of a low side by using a high temperature side as a reference, it is only necessary to make an adjustment in such a manner as to reduce luminance of B (blue).

The adjusting method may further comprise another step, of adjusting luminance of the entire input video signal after the white point is set in the first step. This step is preferable, because luminance (spec value of highest luminance) can be maintained substantially constant even if color temperature setting is changed. A specific example may be providing an inverter circuit, which sets a spec value of luminance in a color temperature side having a largest offset quantity (a minus value) while a backlight still has room, and adjusts highest luminance according to an offset quantity following color temperature setting.

The offset quantity set in the second step may be calculated with accuracy of bits larger in number than those of the input video signal. Accordingly, replacement can be made by selecting an appropriate gray level for realizing desired luminance from higher-density gray levels, and highly accurate convergence of a white point can be realized by a simple constitution. The calculation with accuracy of bits larger in number than those of the input video signal enables gray level coordinates arrayed at equal intervals to be transformed into ones arrayed at unequal intervals corresponding to desired luminance different from luminance of the gray levels. Therefore, convergence of a white point can be realized.

The present invention provides a color image processing method for supplying an entered video gray level signal to a display panel adapted to output a color image. This color image processing method comprises the steps of: setting an achromatic color of a particular gray level at a specified color temperature on the basis of a set transformation quantity; setting an adjusting value for converging a halftone achromatic color different from: the achromatic color of the particular gray level toward the specified color temperature; and adding the set adjusting value to the entered video gray level signal and supplying the signal to the display panel.

The achromatic color of the particular gray level may not be always at a highest gray level. Preferably, however, this achromatic color should be provided in such a manner as to set a white color at least in the vicinity of the highest gray level.

The color image processing method may comprise a step of correcting the deterioration of luminance in the display panel following the setting of an achromatic color of a highest gray level. In this case, panel luminance on the liquid crystal module can be maintained even if the achromatic color of the particular gray level is set at the specified color temperature.

The step of setting the adjusting value may be provided independently of a contrast adjustment executed by a driver for driving the display panel, and the adjusting value may be set on the basis of a set value when a contrast adjustment is made. In this case, even if a contrast adjustment set typically by a user causes a change in $\gamma$ curve, the set white point adjusting value; can be effectively used. In addition, for example, al reference table may be provided for each adjusted contrast on the basis of $\gamma$ adjustment on the driver of the display panel of the liquid crystal module or the like. In this case, following the adjustment of the driver of the display panel, a white point can be maintained constant (a change is limited to a minimum) at each gray level irrespective of contrast setting.

The present invention provides a white point adjusting apparatus for executing an adjustment of an achromatic color level for an input video signal including a plurality of color signals, and displaying an adjusted image on a liquid crystal display module. This apparatus comprises: a first reference table for setting a white point by deciding an offset quantity of at least one color signal from a highest gray level for each color temperature; and a second reference table for setting an offset quantity of the color signal to converge a halftone white point for each color temperature set by the first reference table. Then, the offset quantities set by the first and second reference tables can be added to the input video signal. For example, the apparatus can be constituted by providing the first and second reference tables in a memory (ROM or the like), and installing other constitutions in an integrated circuit such as ASIC.

The first reference table may be adapted in such a way as to increase blue luminance in relative fashion when a color temperature is set to a high side. In this case, a color temperature can be appropriately set even in the case of the LCD having luminance which cannot be increased exceeding highest luminance. For example, as a table constitution to increase blue luminance in relative fashion when a color temperature is set to a high side by using a color temperature of a low side as a default, an offset quantity may be set in such a way as to reduce luminance of red and green. When a color temperature is set to a low side by using a high temperature side asia default value, preferably, the table should be constituted in such a way as to reduce blue luminance.

The white point adjusting apparatus may further comprise an inverter for adjusting a change in luminance on the liquid crystal display module on the basis of the offset quantity set by the first reference table. In this case, even if there is a change in color temperature setting, the apparatus can be constituted in such a way as to maintain, for example, a spec value of highest luminance (a change is limited to a minimum).

The second reference table may be constituted in such a manner as to transform gray level coordinates arrayed at equal intervals to ones arrayed at unequal intervals corresponding to desired luminance. This constitution is preferable, because an adjustment of γ curve can be executed with high accuracy. An example may be a mode of calculation performed with accuracy of bits larger in number than those of the input video data. In this case, color emulation (pseudo color expansion) is applied when the data having a large number of bits after offset calculation is transferred to a panel driver having a smaller number of bits. Thus, the data can be transferred and displayed on the display panel without damaging γ characteristics curve equal to the data having a large number of bits after calculation, in other words, adjusted with high accuracy. As a result, highly accurate convergence of a white point can be realized.

The present invention provides a liquid crystal display device. This liquid crystal display device comprises: a driver for driving a liquid crystal cell on the basis of each of adjusted R, G and B color signals, and executing a contrast adjustment for the liquid crystal cell according to user setting; setting means provided in a stage before the driver to set a white point of a particular gray level in accordance with a hue of a prescribed white color; and adjusting means provided independently of the driver to substantially maintain a hue of a white color set by the setting means for gray scales other than the particular gray level.

The adjusting means may maintain the hue of a white color for each gray level irrespective of a contrast adjustment executed by the driver. In this case, for example, if γ characteristic can be set by an X driver (source driver) for driving the liquid crystal cell, the set white point adjustment can be maintained irrespective of a change in the γ characteristic.

The adjusting means may be capable of adjusting the distribution of luminance among the R, G and B color signals by adding an offset quantity into original γ characteristic of the entered R, G and B color signals, and outputting the result to the driver. Accordingly, different from the general case of, for example a driver adjustment such as a contrast adjustment which is commonly set simultaneously among R, G and B, white point convergence can be realized in a direction of setting white points constant at all gray levels by changing a luminance ratio among R. G and B.

Furthermore, the adjusting means may change an offset quantity on the basis of a reference voltage applied following the contrast adjustment of the driver. In this case, a white point can be set constant for each gray; level while the adjusted contrast adjustment is maintained. For example, if the liquid crystal device is constituted to have a reference table for each adjusted contrast (y characteristic), then white point convergence can be realized irrespective of contrast setting of the liquid crystal cell.

BRIEF DESCRIPTION OF THE DRAWINGS

Preferred embodiments of the present invention will now be described, by way of example only, with reference to the accompanying drawings in which:

FIG. 3 is a view illustrating a content of a first table 46 stored in a memory 22.

FIG. 4 is a view illustrating a content of a second table 47 stored in the memory 22.

DETAILED DESCRIPTION OF THE PREFERRED EMBODIMENTS OF THE INVENTION

Next, detailed description will be made for the present invention on the basis of the preferred embodiments shown in the accompanying drawings.

Figure 1:
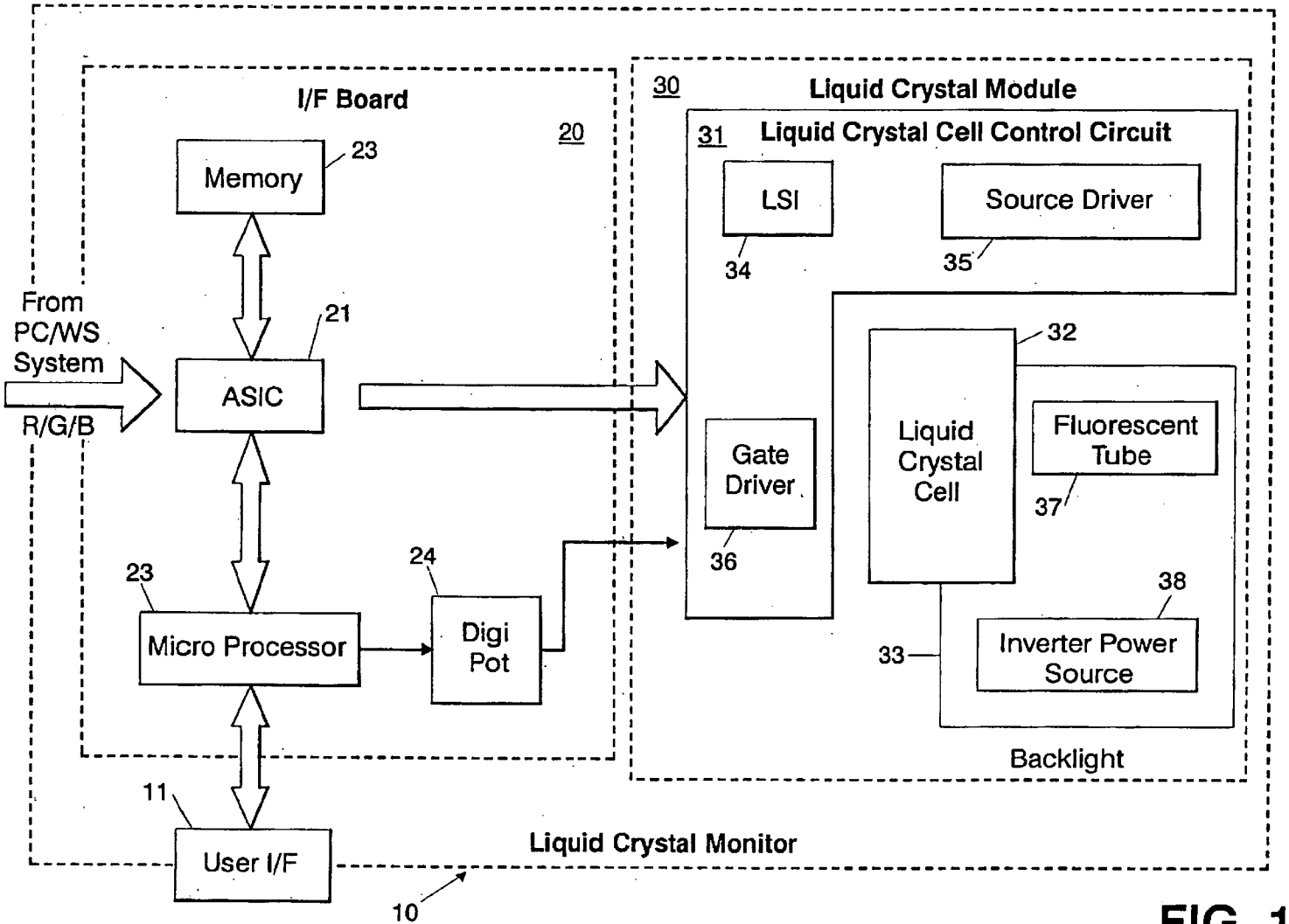
FIG. 1 is a view illustrating an entire constitution of a liquid crystal display device according to an embodiment of the invention.

FIG. 1 is a view illustrating an entire constitution of a liquid crystal display device according to an embodiment of the present invention. A reference numeral 10 denotes a liquid crystal monitor (LCD monitor) as a liquid crystal display panel, which includes a liquid crystal; module 30 having, for instance a thin-film transistor (TFT) structure, and an interface (I/F) board 20 connected to a digital or analog interface from a PS or WS system to supply a video signal to the liquid crystal module 30. In the case of a notebook PC, a system unit (not shown) is added to this liquid crystal display monitor 10. If a display constitutes a monitor independently of a system device, the system device (not shown) is added to the liquid crystal display monitor 10 to constitute a liquid crystal display device. The liquid crystal display monitor 10 is provided with a user I/F 11 such as an input switch or the like, which enables a user to enter an adjusting value (transformation quantity), for example when a contrast adjustment is carried out. The adjusting value can be entered by a system of popping-up the adjusting value by an on-screen display (OSD). More specifically, respectively for R, G and B color signals, adjusting values for attenuation or the like of the R, G and B color signals can be entered at respective gray levels (e.g., 32 stages).

The I/F board 20 includes an ASIC 21 mounting a logical circuit thereon to perform various adjustments, addition or the like for an input video signal, and a memory 221 storing table information or the like necessary for the movement of the ASIC 21. The I/F board 20 further includes a microprocessor 23 for controlling the user I/F 11, and a digital potential (Digi Pot) 24 for executing γ adjustment upon receiving information from the microprocessor 23.

On the other hand, the liquid crystal module 30 is largely composed of three blocks, i.e., a liquid crystal cell control circuit 31, a liquid crystal cell 32 and a backlight 33. The liquid crystal cell control circuit 31 includes, as panel driver components, an LCD controller LSI 34, a source driver (X driver) 35 and a gate driver (Y driver) 36. The LCD controller LSI 34 processes a signal received via a video interface from the I/F board 20, and outputs a signal to be supplied to each IC of the source driver 35 and the gate driver 36 by a necessary timing. The liquid crystal cell 32 receives a voltage from each of the source driver 35 and the gate driver 36, and outputs an image based on a TFT array on a matrix. The backlight 33 is provided with a fluorescent tube 37 to be lit by an inverter power source 38, and arranged in the backside or side face of the liquid crystal cell 32 to project a light from the backside. Note that the inverter power source 38 is constituted such that luminance can be adjusted by a later-described inverter circuit.

Figure 2:
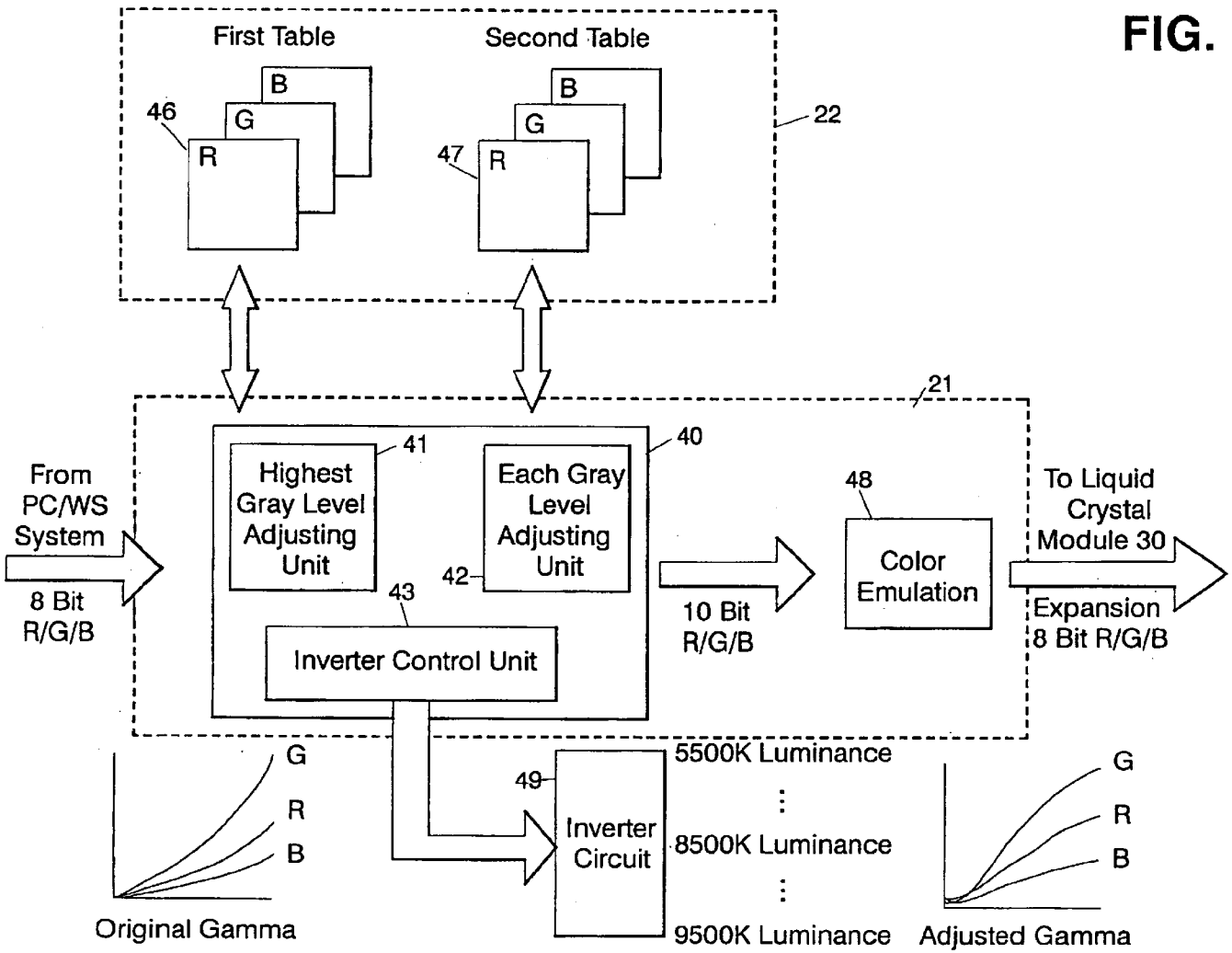
FIG. 2 is a functional block diagram illustrating features of the embodiment.

FIG. 2 is a functional block diagram illustrating features of the embodiment. The ASIC 21 includes a white point adjusting unit 40, and color emulation (pseudo color expansion) 48. R/G/B data received by 8 bits from the PC or WS system is adjusted by a highest gray level adjusting unit 41 and each gray level adjusting unit 42 in accordance with a set color temperature and a gray level of each color that has been entered. In this case, the highest gray level adjusting unit 41 and each gray level adjusting unit 42 respectively make adjustments by adding in prescribed offset quantities while referring to first and second tables 46 and 47 provided in the memory 22. An inverter control unit 43 is also provided to change an inverter output in accordance with a set color temperature. A control signal from this inverter control unit 43 is supplied to an inverter circuit 49 provided to control the inverter power source 38 of the liquid crystal module 30, and backlight luminance is maintained constant for each set color temperature. According to the embodiment, original Gamma ( ) is calculated (offset) with accuracy of bits (10 bits) larger in number than bits (8 bits) of the input video data, and adjusted Gamma is outputted. In the color emulation 48, however, when the calculated (after offset) data having a large number of bits is transferred to the panel driver (liquid crystal cell control circuit 31) having a small number of bits (8 bits), data equal to a large number of bits can be received/transmitted by applying dither or FRC (frame control).

Next, description will be made for each color temperature setting at a highest gray level, which is performed in the highest gray level adjusting unit 41.

FIG. 3 shows a content of the first table 46 stored in the memory 22. This table is used to decide an offset quantity for each white point setting (color temperature). A color temperature (white point) coordinate moves along a black body locus on the CIE chromaticity coordinate, and moves toward a blue direction as a color temperature increases. Accordingly, blue luminance must be increased to set a color temperature to a high temperature side. In the case of the LCD, however, luminance cannot be increased exceeding luminance of the highest gray level. Thus, the embodiment employs a method of increasing blue luminance in relative fashion by reducing luminance of red and green. With this method, the first table 46 shown in FIG. 3 is prepared such that a white point of the highest gray level can come to each color temperature coordinate on the CIE chromaticity coordinate. This first table is made by setting offset quantities of red and green from the highest gray level for each color temperature in accordance with a characteristic of the LCD to be used. In FIG. 3, 5500K is a reference. The offset quantities are respectively values subtracted from the highest gray level, and take minus values. Such values r1 to r4 and g1 to g4 are provided with accuracy of 8 bits or more (e.g., 10 bits) if input RGB data is 8 bits. In the highest gray level adjusting unit 41, red and green are reduced from, for example a highest gray level 255 by the above values. For the table shown in FIG. 3, an offset value obtained from an actually measured value of the LCD is decided in accordance with the characteristic of the LCD to be used as described above. If a different LCD is used, a different offset value is stored. In FIG. 3, 5500K is a reference, but 9500K of a high temperature side can be used instead. In this case, to set a white point of a lower temperature side, a reference table may be prepared in such a manner as to reduce blue luminance rather than red and green.

Herein, if red and green offset adjustments are carried out on the basis of the table shown in FIG. 3, a problem of a reduction in luminance occurs with a color temperature increase unless any considerations are given in this regard. In other words, as a result of increasing blue luminance in relative fashion by reducing red and green luminance, with high color temperature setting, a luminance spec value cannot be satisfied at 5500K as a reference. To solve this problem, according to the embodiment, the inverter control circuit 43 shown in FIG. 2 performs inverter control while the backlight has room, and output its result to the inverter circuit 49. In other words, in the case of the table shown in FIG. 3, a luminance spec value is defined by a high color temperature side (9500K), and when a low color temperature is set, the luminance spec value is maintained by automatically switching an inverter output such that a reduction is made to highest luminance at the time of high color temperature setting. Thus, a spec value of highest luminance can be prevented from being changed even if a change occurs in color temperature setting. Specifically, when setting a white point (color temperature), panel luminance is changed at high and low temperature settings unless any considerations are given in this regard. According to the embodiment, however, by switching an inverter output depending on each set color temperature, a change of highest luminance can be limited to a minimum.

Instead of the table shown in FIG. 3, as described above, if a reference table is prepared in such a manner as to reduce blue luminance when setting a white point of a low temperature side by using 9500K of a high temperature side as a reference, inverter control to be performed is opposite to the foregoing, and a similar effect can be obtained by defining a luminance spec value with a low color temperature side (5500K) and reducing highest luminance at the time of high color temperature setting.

Next, description will be made for an adjustment of an offset quantity at a prescribed color temperature, which is performed in each gray level adjusting unit 42.

FIG. 4 shows a content of the second table 47 stored in the memory 22. This table is used to decide an offset quantity for each color temperature set by the highest gray level adjusting unit 41 based on the first table in such a way as to maintain a white point substantially constant (converged) at all the gray levels. In other words, even if a chromaticity coordinate of each color temperature is set at a highest gray level as described above, a white point can be converged by paying attention to the problem of shifting from the set coordinate at other gray levels and then deciding offset quantities of red, green and blue at each gray level in accordance with a characteristic of the LCD to be used. In FIG. 4, values rr1 to rr9, gg1 to gg9 and bb1 to bb9 are offset quantities provided with accuracy of 8 bits or more (e.g., accuracy of 10 bits) when input RGB data is 8 bits, and 9 points are extracted from 256 gray levels including a lowest gray level. But, the number of points to be extracted can be optionally decided.

Detailed description will now be made for an adjustment of an offset quantity at a specified color temperature using the table shown in FIG. 4, by taking an example of an 8 bit color gray level as input video data.

Figure 5A:
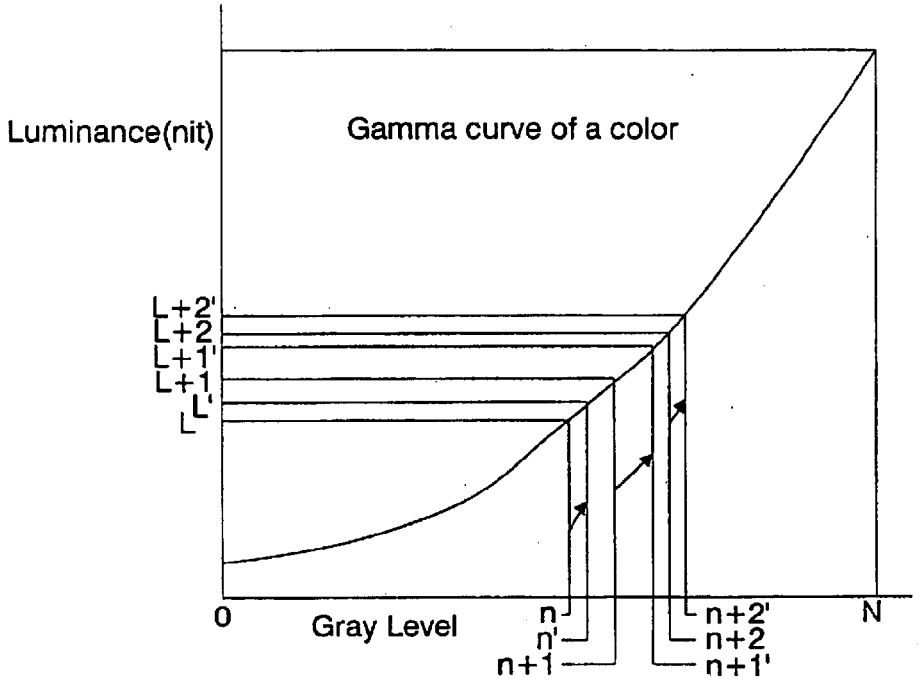
FIGS. 5(*a*) and 5(*b*) are views illustrating a method of adjusting γ (Gamma) characteristic based on transformation of gray level intervals according to the embodiment.
Figure 5B:
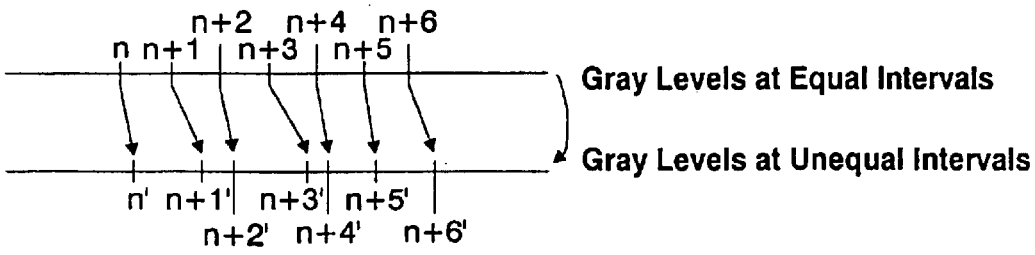

FIGS. 5(*a*) and 5(*b*) are views illustrating a method of adjusting γ (Gamma) characteristic on the basis of transformation of gray level intervals according to the embodiment. In the case of the LCD, 0 to 255 gray levels of R/G/B (in the case of 8 bits) correspond to liquid, crystal driving voltages (not shown) by one to one through a D/A converter (DAC) (not shown) in the liquid crystal cell control circuit 31 of the liquid crystal module 30. Luminance of each color at a corresponding level is realized on the LCD by means of a liquid crystal driving voltage, and chromaticity of a mixed color (e.g., white) on the CIE chromaticity coordinate is decided on the basis of distribution of luminance among the respective colors. It should be noted, however, that a reference voltage of a driver for each of R, G and B of the liquid crystal module 30 is set in common among R, G and B.

Generally, in order to maintain a white point defined at the highest gray level of a white color for a white color of other gray levels, distribution of luminance among R G and B must be adjusted at each gray level in accordance with a characteristic of an LCD to be used. This means that γ characteristic of each color of R, G and B must be changed independently. However, since reference voltage setting of the driver (source driver 35) on the liquid crystal module 30 is usually carried out in common among R, G and 8, this operation (independent setting for each color) is not permitted in the driver side. Thus, γ characteristic must be adjusted independently for each of R, G and B in a previous stage, and passed to the driver of the liquid crystal module 30. Herein, γ curve representing a relation between a gray level of each color and corresponding luminance becomes one like that shown in FIG. 5(*a*). In the drawing, the axis of abscissa indicates gray levels arrayed at equal intervals, and the axis of ordinate indicates luminance. Changing of luminance corresponding to each gray level of the axis of abscissa means an adjustment of the γ curve. However, as described above, setting of a reference voltage cannot be changed independently for each color on the liquid crystal module 30 side. Consequently, γ characteristic cannot be changed for each color.

Therefore, according to the embodiment in, γ curve for each color, gray level coordinates arrayed at equal intervals are transformed into gray level coordinates at unequal intervals in order to set coordinates to desired luminance different from corresponding luminance. In other words, as shown in FIGS. 5(*a*) and 5(*b*), a gray level for realizing desired luminance is selected from higher-density gray levels (for example, 10 bits, 1024 gray levels) existing among the gray level coordinates;

(e.g., 256 (in the case of 8 bits)) arrayed at equal intervals, and an original gray level is replaced by this selected gray level. For example, in FIG. 5(*a*), assuming that luminance corresponding to n gray level is L, the n gray level is replaced by n' gray level which is multilevel if L' is desired for a luminance adjustment. Similarly, in accordance with desired luminance, n+1 is replaced by n+1', n+2 by n+2', and so on, thereafter. A quantity of such replacement is decided on the basis of the offset quantity shown in the second table of FIG. 4. FIG. 5(*a*) illustrates transformation of gray level intervals. It can be understood that the multilevel transformation of the embodiment enables the gray level coordinates arrayed at equal intervals to be transformed into ones at unequal intervals corresponding to desired luminance different from the corresponding luminance thereof. According to the embodiment, apparently, by means of calculation with accuracy of bits larger in number than those of the input video data, an adjustment of γ characteristic curve can be carried out easily and highly accurately.

According to the embodiment, to adjust a white point for each gray level, as it is impractical to execute an adjustment at all of the 256 gray levels, 9 gray levels including highest and lowest gray levels arrayed at equal intervals are adjusted to be transformed into ones at unequal intervals, and interpolation is carried out between the 9 gray level. Any kind of interpolating method can be used, and an almost satisfactory result can be obtained by linear two-point interpolation.

With the embodiment, an adjustment is carried out with accuracy of 10 bits in the case of 8 bit color gray level and, when data is passed to the driver of the 8 bit liquid crystal module 30, 10 bit equivalence is set in the color emulation 48 described above with reference to FIG. 2. In the color emulation 48, 10 bit equivalence is realized by, for example dither or FRC (frame control).

As apparent from the foregoing, according to the embodiment, separately from and independently of a contrast adjustment by the liquid crystal module 30 from the user I/F 11, an white point adjustment can be carried out by providing adjusted γ characteristic to the original γ characteristic in the previous stage. As a result, different from the conventional case where all of the previous settings become unusable when a change occurs in γ curve, it is possible to execute a desired white point adjustment in accordance with a contrast adjustment of a latter stage. Moreover, by adjusting γ characteristic of each color independently of the liquid crystal module 30, it is possible to dynamically provide unique γ characteristics to a plurality of applications in one screen, such as usual PC applications, moving picture applications window-displayed therein or the like.

Figure 6:
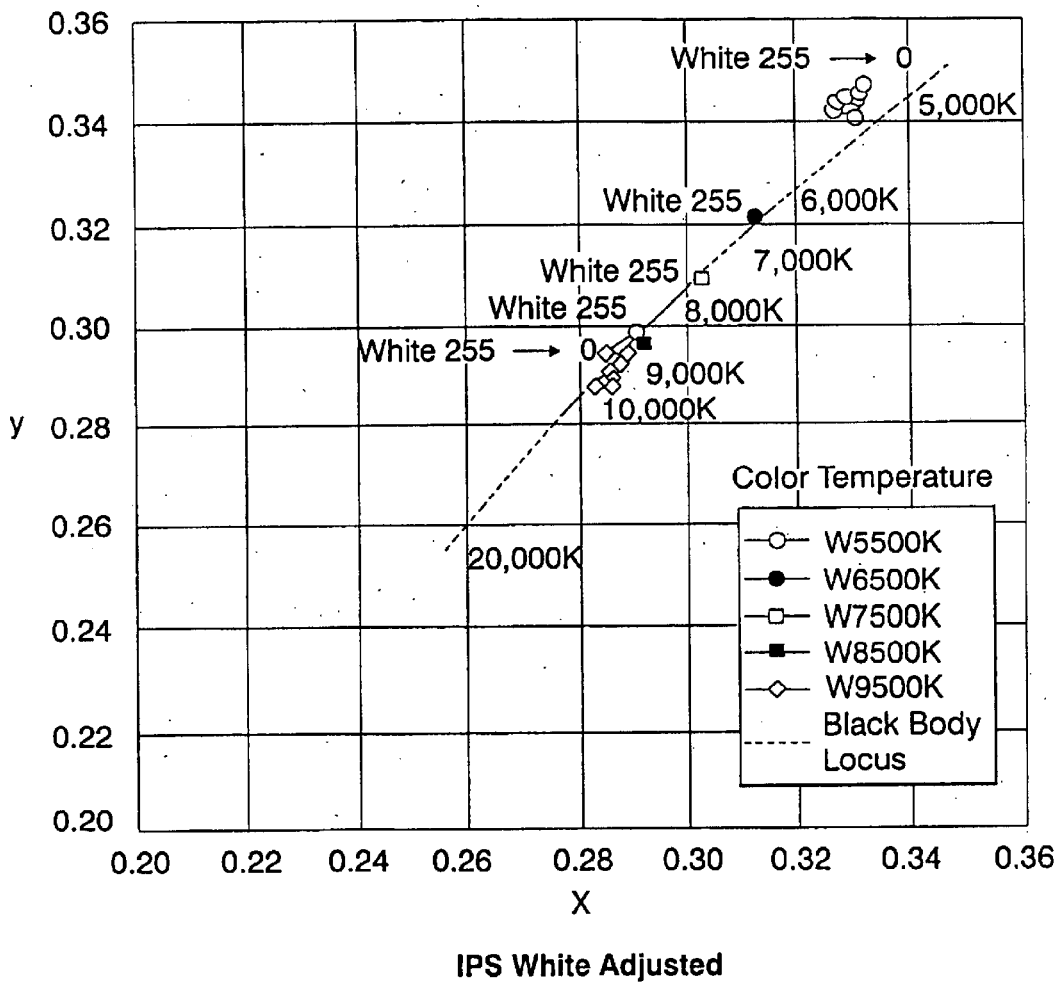
FIG. 6 is a view showing an example of a result of adding a white point adjustment according to the embodiment.
Figure 7:
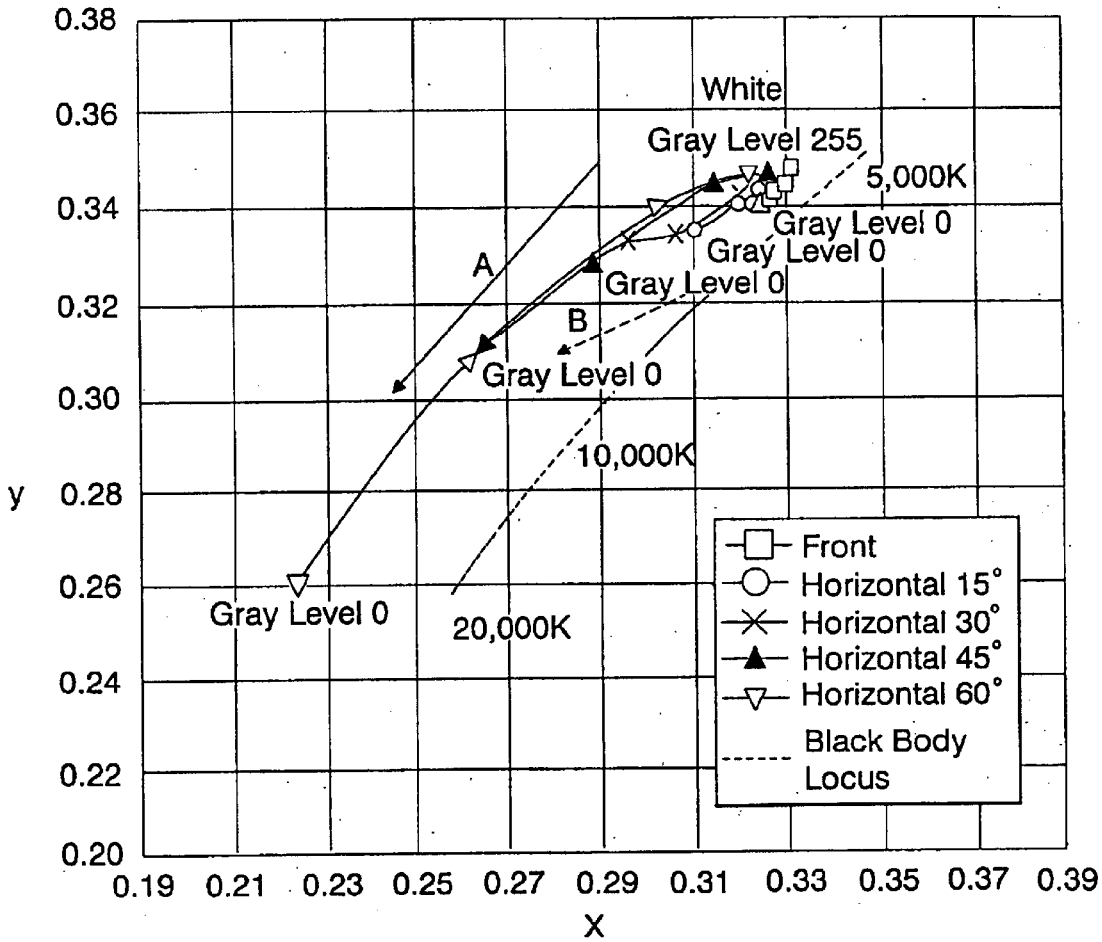
FIG. 7 is a view showing an example of adding a white point adjustment according to the embodiment.
Figure 8:
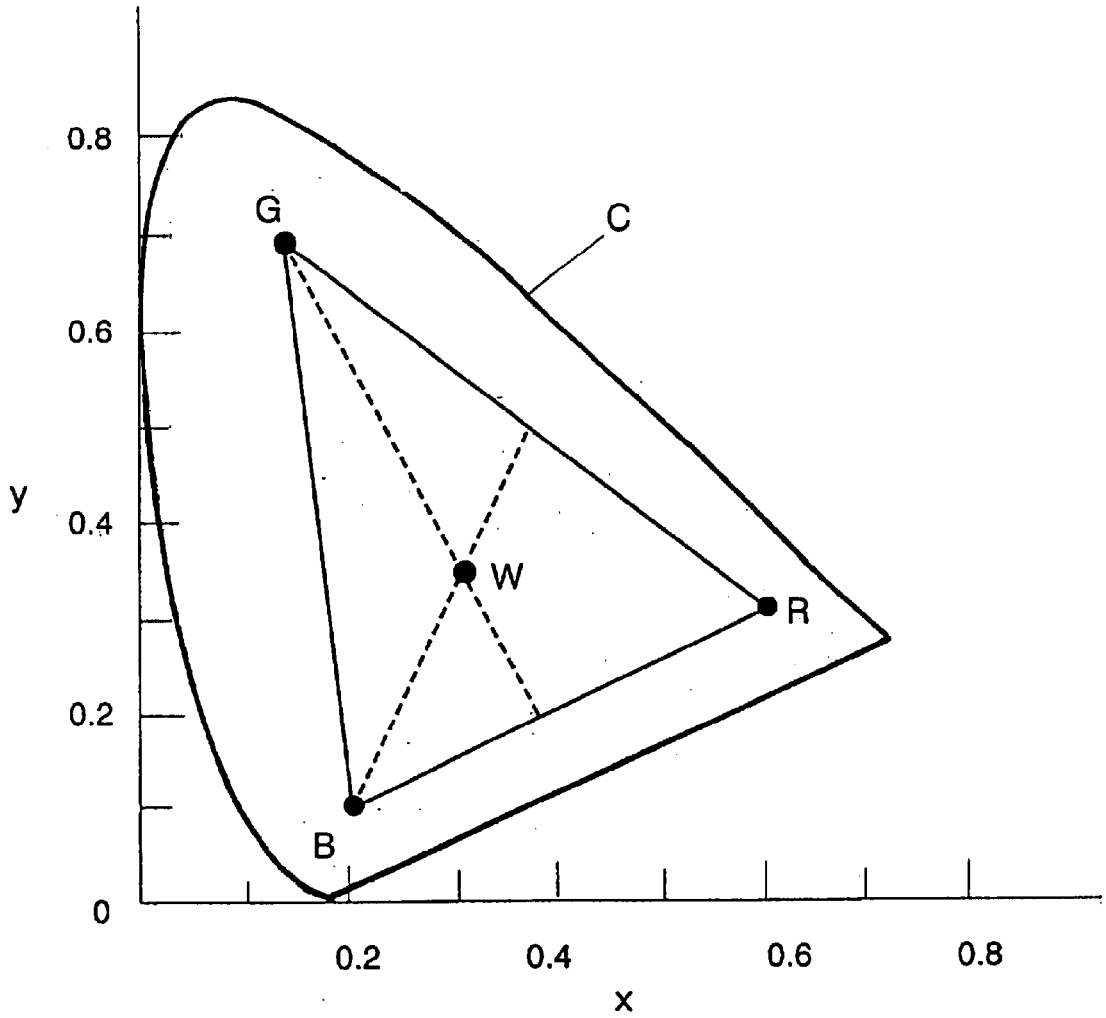
PRIOR ART FIG. 8
FIG. 8 is a typical CIExy chromaticity diagram illustrating the invention.
Figure 9:
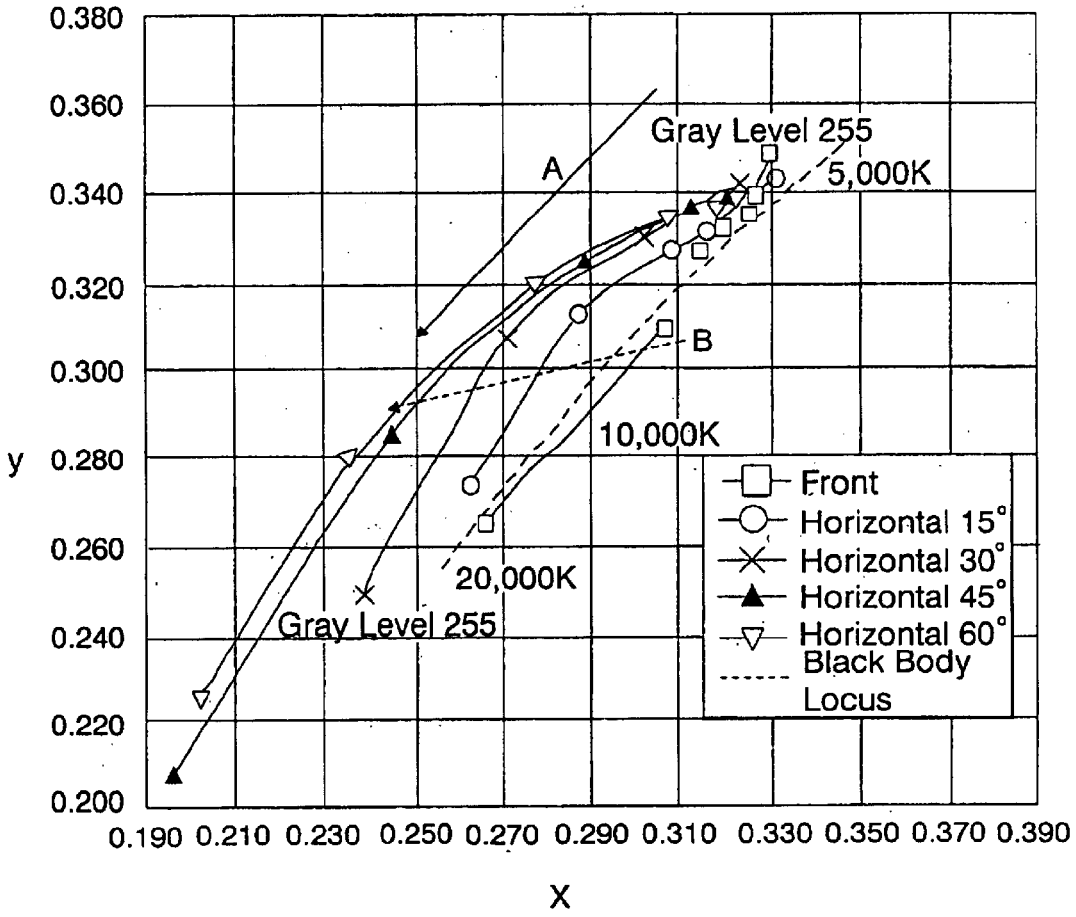
PRIOR ART FIG. 9
FIG. 9 is a view illustrating a change in color temperature for each gray level in an LCD.

Each of FIGS. 6 and 7 shows an example of a result of adding a white point adjustment according to the embodiment. Specifically, FIG. 6 shows a result of each color temperature setting from 5500K to 9500K in the highest gray level adjusting unit 41 on a CIE chromaticity coordinate, and a result of adding an adjustment for maintenance of a constant white point at color temperatures 5500K and 9500K in each gray level adjusting unit 42. As apparent from comparison of FIG. 6 with no adjustment addition described above with reference to FIG. 9, it can be understood that with the embodiment, a white point is realized along a black body locus at each color temperature as a set. It can also be understood that at color temperatures 5500K and 9500K, a white point is converged without any great changes even if a gray level is different.

FIG. 7 shows shifting of a white point caused by viewing angle shifting, which results from the addition of a white point adjustment of the embodiment. From comparison of FIG. 7 with no adjustment addition of FIG. 9, it can be understood that changes are reduced in both of a solid-line arrow A and a broken-line arrow B, the arrow A indicating a moving direction of a white point at each gray level when a viewing angle is increased in at horizontal direction, and the arrow B indicating a moving direction of each gray level when a viewing angle is increased, and white point shifting caused by the viewing angle is reduced.

Therefore, with the embodiment, a white point adjustment can be executed for each of R, G and B independently of one another and optionally in the previous stage for the source driver (X driver) 35 usually setting γ characteristic of the liquid crystal module 30 simultaneously among R, G and B.

According to the embodiment, if γ adjustment is made by the source driver 35 of the liquid crystal module 30, a second table 47 can be provided for each adjusted γ characteristic (each contrast). As a result, it is possible to maintain a white point substantially constant (converged) for each gray level by changing an offset quantity irrespective of panel contrast setting.

Furthermore, it is possible to minimize a phenomenon which becomes a problem especially in the LCD, the phenomenon being, for example conspicuous blue shifting caused by shifting of a viewing angle (angle with which the user sees the display).

As described above, the present invention is advantageous in that a set color temperature of a white point can be maintained substantially constant even at a different gray level, and a highly accurate white point adjustment can be realized.

While the invention has been particularly shown and described with respect to preferred embodiments thereof, it will be understood by those skilled in the art that the foregoing and other changes in form and details may be made therein without departing form the spirit and scope of the invention.

What is claimed is:

1. A white point adjusting method for adjusting an achromatic color level to be displayed on a liquid crystal module for an input video signal including a plurality of color signals, comprising:

a first step of setting a color temperature of a white point by deciding an offset quantity of at least one color signal from a highest gray level for each color temperature;

a second step of setting an offset quantity of the color signal in a direction of converging a halftone white point for each color temperature set in the first step wherein said offset quantity is calculated with an accuracy of bits larger in number than the total number of bits of the input video signal; and a third step of adjusting chromaticity on a screen of the liquid crystal module by adding the offset quantity decided in the first step and the offset quantity set in the second step to the input video signal.

2. The white point adjusting method according to claim 1, wherein said input video signal is composed of R, G and B color signals, the white point setting in the first step is executed by using a prescribed color temperature as a default value, and luminance of the R and G color signals is reduced when a color temperature is set to a high temperature side with respect to the prescribed color temperature.

3. The white point adjusting method according to claim 2, the method further comprising:

a step of adjusting luminance of the entire input video signal after a white point is set in the first step.

4. A color image processing method for supplying an entered video gray level signal to a display panel for outputting a color image, comprising the steps of:

setting an achromatic color of a particular gray level at a specified color temperature on the basis of a set transformation quantity;

setting an adjusting value for converging a halftone achromatic color different from the achromatic color of the particular gray level toward the specified color temperature, wherein said adjusting valve is calculated with an accuracy of bits larger in number than the total number of bits of the entered video signal; and adding the set adjusting value to the video gray level signal, and then supplying the signal to the display panel.

5. The color image processing method according to claim 4, the method further comprising:

a step of correcting deterioration of luminance in the display panel following the setting of a highest gray level achromatic color.

6. The color image processing method according to claim 4, wherein the step of setting the adjusting value is provided independently of a contrast adjustment executed by a driver for driving the display panel, and the adjusting value is set on the basis of a set value when the contrast adjustment is carried out.

7. A white point adjusting apparatus for adjusting an achromatic color level for an input video signal including a plurality of color signals, and displaying an adjusted image on a liquid crystal display module, comprising:

a first reference table for setting a color temperature of a white point by deciding an offset quantity of at least one color signal from a highest gray level for each color temperature; and a second reference table for setting an offset quantity of the color signal to converge a halftone white point for each color temperature set by the first reference table, wherein said offset quantity is calculated with an accuracy of bits larger in number than the total number of bits of the input video signal, and wherein the offset quantities set by the first and second reference tables are added to the input video signal.

8. The white point adjusting apparatus according to claim 7, wherein said first reference table is constituted to increase blue luminance in relative fashion when the color temperature is set to a high temperature side.

9. The white point adjusting apparatus according to claim 7, further comprising:

an inverter for adjusting a change of luminance on the liquid crystal display module on the basis of the offset quantity set by the first reference table.

10. The white point adjusting apparatus according to claim 7, wherein said second reference table transforms gray level coordinates arrayed at equal intervals in γ curve of the color signal into gray level coordinates at unequal intervals corresponding to desired luminance.

11. A liquid crystal display device comprising:

a driver for driving a liquid crystal cell on the basis of adjusted R, G and B color signals, and executing a contrast adjustment for the liquid crystal cell according to user setting;

setting means provided in a stage before the driver to set a color temperature of a white point of a particular gray level according to a hue of a specified white color; and adjusting means provided independently of the driver to make an adjustment: in order to substantially maintain the hue of the white color set by the setting means for gray scales other than the particular gray level, wherein said adjusting means calculates said adjustment with an accuracy of bits larger in number than the total number of bits of the R, G and B color signals.

12. The liquid crystal display device according to claim 11 wherein said adjusting means maintains the hue of the white color for each gray level irrespective of the contrast adjustment executed by the driver.

13. The liquid crystal display device according to claim 11, wherein said adjusting means adjust distribution of luminance among the R, G and B color signals, by adding an offset quantity into original γ characteristic of each of the entered R, G and B color signals, and then outputs a result thereof to the driver.

14. The liquid crystal display device according to claim 13, wherein said adjusting means changes the offset quantity on the basis of a reference voltage applied following the contrast adjustment executed by the driver.

* * * * *